US005787110A

United States Patent [19]

Fishman et al.

[11] Patent Number: 5,787,110

[45] Date of Patent: Jul. 28, 1998

[54] GALVANIZING APPARATUS WITH CORELESS INDUCTION FURNACE

[75] Inventors: Oleg S. Fishman, Maple Glen, Pa.; John H. Mortimer, Mt. Laurel; Vitaly A. Peysakhovich, Moorestown, both of N.J.

[73] Assignee: Inductotherm Corp., Rancocas, N.J.

[21] Appl. No.: 551,660

[22] Filed: Nov. 1, 1995

[51] Int. Cl.[6] ..... H05B 6/22

[52] U.S. Cl. ..... 373/151; 219/609; 219/672; 373/146; 373/152; 373/166

[58] Field of Search ..... 373/151, 152, 373/153, 155, 156, 141, 142, 159, 146, 166; 219/600, 609, 634, 635, 672; 427/321, 349, 433, 45; 118/63, 67, 69

[56] References Cited

U.S. PATENT DOCUMENTS

| | | | |
|---|---|---|---|
| 2,647,304 | 8/1953 | Cook et al. | 29/194 |
| 3,519,719 | 7/1970 | Fadler | 373/159 |
| 3,602,625 | 8/1971 | Duca | 373/160 |
| 5,354,970 | 10/1994 | Knupfer | 219/609 |

FOREIGN PATENT DOCUMENTS

| | | |
|---|---|---|
| 0 419 296 | 3/1991 | European Pat. Off. . |
| 0 577 273 | 1/1994 | European Pat. Off. . |
| 662 524 | 12/1951 | United Kingdom . |

OTHER PUBLICATIONS

Patent Abstracts of Japan, vol. 8, No. 241 (C-250), 6 Nov. 1984 & JP 59 123753 (Sumitomo Kinzoku) 17 Jul. 1984 abstract.

Derwent Publications Ltd., SU 685 712 (Belyi) 18 Sep. 1979 Abstract.

*Primary Examiner*—Tu B. Hoang
*Attorney, Agent, or Firm*—Seidel, Gonda, Lavorgna & Monaco, PC

[57] ABSTRACT

A galvanizing apparatus comprising a vessel for containing a melt of molten metal. The vessel includes at least one conical projection in its side walls around which an induction heating coil is wound to generate a uniform and continuous stirring pattern of molten metal that penetrates deeply into the pot. In a second embodiment, the galvanizing vessel has no projections from its side walls, but comprises instead one or more flat inductors disposed on the exterior wall of the vessel. The flat inductor is surrounded by magnetic return shunts for directing the magnetic force field created by the inductor.

11 Claims, 4 Drawing Sheets

GALVANIZING APPARATUS WITH CORELESS INDUCTION FURNACE

FIELD OF THE INVENTION

The present invention is related to the field of galvanizing equipment for coating metallic strip, and particularly to induction heating vessels employed to heat and contain coating metals.

BACKGROUND OF THE INVENTION

In the manufacture of strip metals, it is often necessary to coat the strip metal with a second metal for galvanizing the base material. This operation is performed by passing the strip base metal through an apparatus which feeds the strip into a bath of molten galvanizing metal. Ideally, while passing through the bath the strip material receives an even coating of the galvanizing metal, which cools and bonds with the base metal as it emerges from the molten bath.

The galvanizing metal, held in a vessel in the apparatus, must be kept in a liquid state for the operation, which requires continual heating. The vessel (also called a galvanizing "pot") holding the molten metal is equipped with one or more induction heating elements to heat the galvanizing metal.

Most galvanizing pots comprise a rectangular reservoir containing liquid metal (Zn, Al, Si) through which the continuous metal strip passes. Metal in galvanizing pots has heretofore been heated by channel induction furnaces mounted in the sides of the pot. In a channel induction furnace, an induction heating element is placed in the interior of a small channel in the side of the galvanizing pot.

Galvanizing pots using channel induction furnaces were susceptible to frequent clogging because there was a small clearance between the induction heating element and the interior surfaces of the channel. Dross forming metals easily plugged these channels. Channel inductors limit the application of aluminum, a popular galvanizing metal, because aluminum forms dross (oxides in molten metals) on comparatively cool furnace walls.

The problems with dross formation in channel induction furnaces led to the development of coreless induction furnaces for galvanizing equipment. The coreless furnace continuously heats the molten metal (the "melt") in the galvanizing pot to keep it liquid. An important function of the furnace is to create stirring currents in the melt so that it remains uniformly heated, maintaining the correct temperature for bonding with the base metal strip.

The typical coreless induction furnace has a cylindrical heating element surrounding a cylindrical projection from the side of the galvanizing pot. The stirring current pattern in a cylindrical coreless furnace has a distinct two-vortex pattern. One of the stirring vortices remains entirely within the heating cylinder, providing little or no stirring energy to the melt in the pot. The second vortex projects into the melt from the cylinder, but in a generally horizontal direction that limits its stirring effect above and below the level of the cylinder. Dross formation can again be a problem in a coreless induction furnace where the stirring currents excited by the induction heating element are not sufficient to uniformly mix the melt.

SUMMARY OF THE INVENTION

The present invention is directed toward resolving the problems associated with both the channel induction element and the cylindrical coreless inductor furnaces.

The present invention is a galvanizing apparatus comprising a vessel for containing the melt. In a first embodiment, the vessel includes at least one, and usually two or more, conical projections in its side walls around which an induction heating coil is wound. The purpose of a conically shaped inductor mounted in the side walls of the coating pot is to generate a uniform and continuous stirring pattern of molten metal that penetrates deeply into the pot.

In a second embodiment of the invention, the galvanizing vessel has no projections from its side walls, but comprises instead one or more flat inductors disposed on the exterior wall of the vessel. The flat inductors are wound devices which can take various shapes, usually round or rectangular. The stirring currents produced by flat heating inductors project in a perpendicular direction from the side wall adjacent the flat inductor. The external mounting of the flat inductor allows the galvanizing vessel to have a straight side wall, maintaining the integrity of the refractory that lines the interior of the vessel. The flat inductor heating element incorporates magnetic return shunts for directing the magnetic force field created by the inductor.

DESCRIPTION OF THE DRAWINGS

For the purpose of illustrating the invention, there are shown in the drawings forms which are presently preferred; it being understood, however, that this invention is not limited to the precise arrangements and instrumentalities shown.

DESCRIPTION OF THE INVENTION

Figure 1:
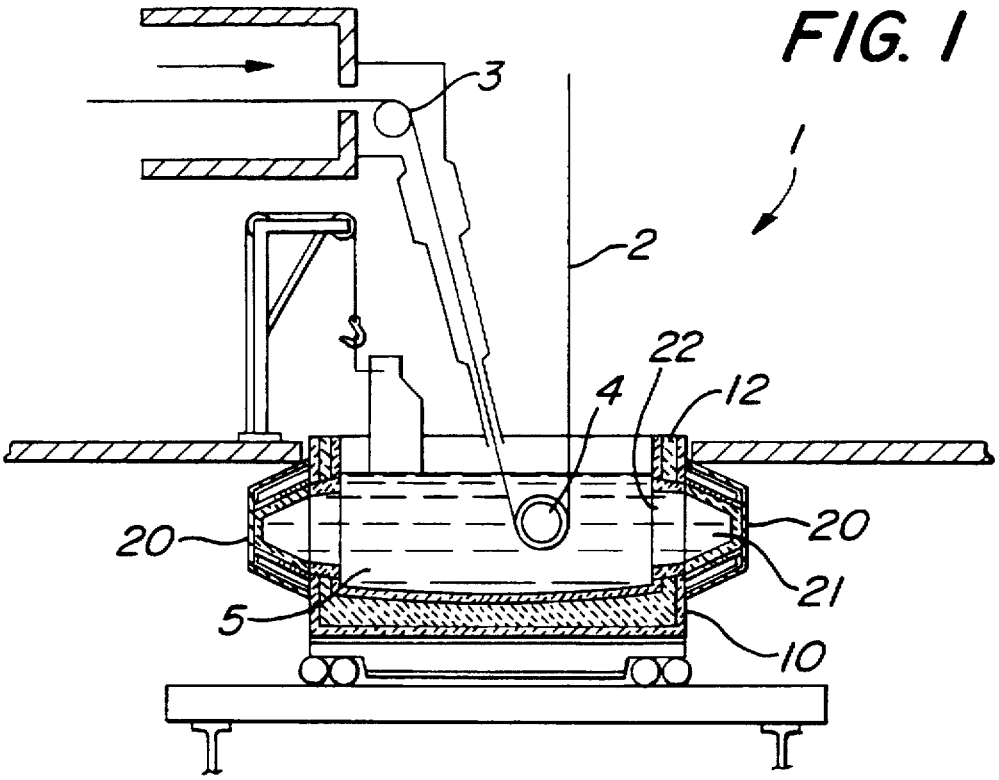
FIG. 1 is a vertical section view of a galvanizing apparatus according to the present invention.

A galvanizing apparatus 1 according to a first embodiment of the present invention is depicted in FIG. 1. A continuous metal strip 2 passes over rollers 3, 4 to be directed into, through, and out of a bath of molten galvanizing metal 5. The molten metal 5 is contained in a vessel (or "pot") 10. Attached to the vessel 10 is at least one conical coreless induction furnace 20. The interior space 21 of the conical furnace 20 communicates with the interior of the vessel 10 through an opening 22 in the side wall 12 of the vessel 10.

Figure 2:
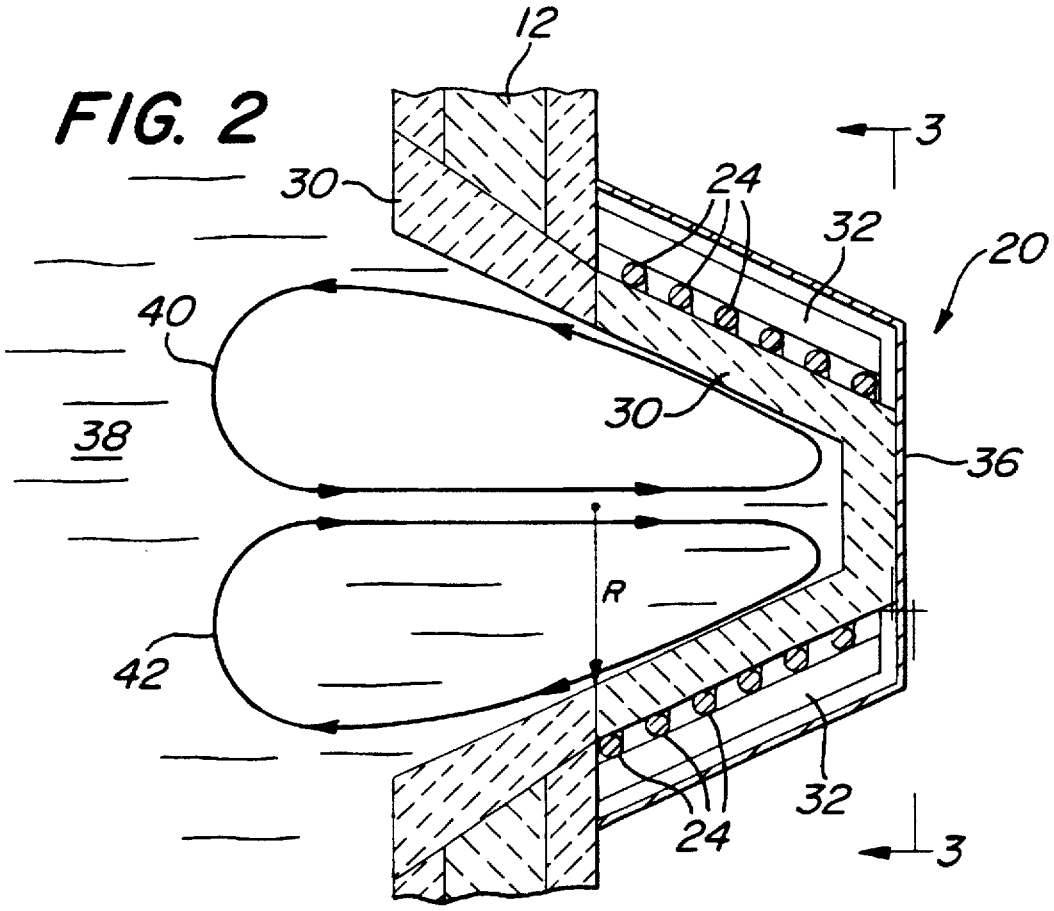
FIG. 2 is a vertical section view of a conical projection from the side wall of a galvanizing vessel.

FIG. 2 shows the conical furnace 20 in detail. The conical furnace 20 is mounted on the side wall 12 of the vessel with the largest radius R of the conical shape adjacent to the side wall 12. The radius R decreases along the outward projection of the conical furnace 20 from the side wall 12.

Both the side wall 12 of the vessel and the interior surface of the conical furnace 20 are lined with a refractory material 30 to protect the vessel 10 and furnace 20 from the extreme heat of the molten metal.

The furnace 20 has an induction heating coil 24 wound in a plurality of turns outside the refractory material 30 conforming to the conical shape of the furnace. A plurality of magnetic shunts 32 overlie the coil turns 24 to confine and direct the magnetic field that the coil 24 produces when energized by alternating frequency current. An exterior shell 36, which may be metal, polymeric, ceramic or other material, encloses the conical furnace 20.

Energizing the induction coil 24 in the conical furnace with an alternating current creates a strong magnetic field that alternately expands and collapses at the same frequency as the energizing current. In accordance with well-known principles, the magnetic field induces an electric current in the melt 38. The interaction of the electric current and the inherent resistance of the metal comprising the melt generates the heat that keeps the melt 38 liquid.

Along with electric current, other forces are at work in the melt. A physical force within the melt results from the interaction of the magnetic field and the induced electric current in the melt. This force, known as the Lorentz force, causes stirring currents 40, 42 to flow within the melt 38. The stirring currents move the hottest metal away from the conical furnace 20 and draw cooler metal into the furnace.

Figure 3:
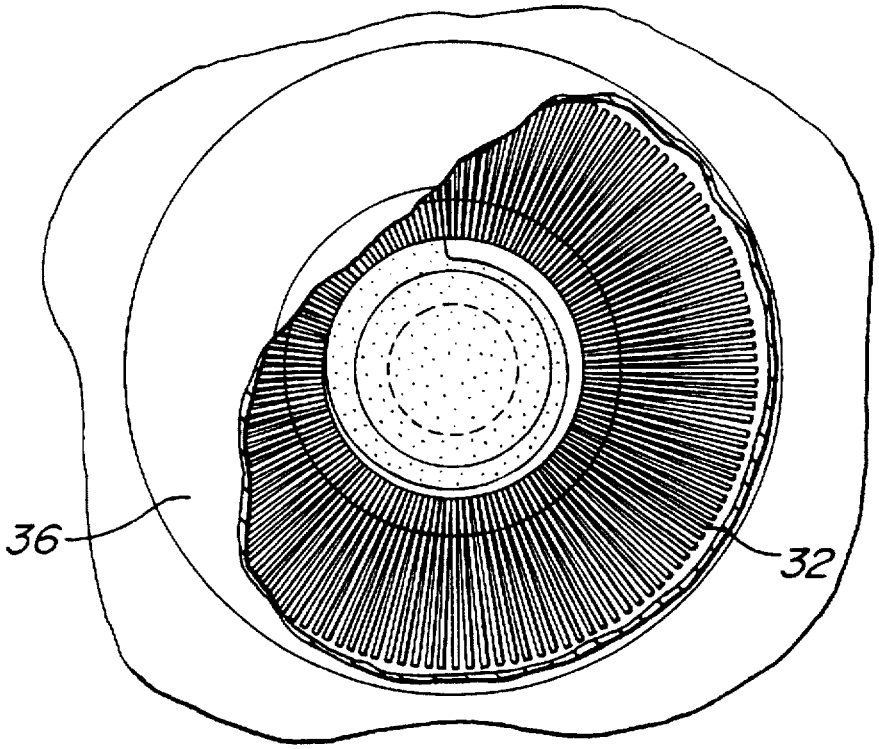
FIG. 3 is a partial cutaway view of a conical induction furnace in in the direction 3—3 indicated in FIG. 2.

FIG. 3 shows the arrangement of the magnetic shunts over the coil winding in the conical furnace. The exterior shell 36 of the furnace is shown in a partial cutaway view, with the narrow end of the conical furnace (at the center of the Figure) closest to the viewer and the widest radius of the cone (where it joins the side wall of the vessel) farther away. Each magnetic shunt 32 is a thin ferrous strip having flat faces on two sides and two narrow edges on its top and bottom. Each shunt 32 is arranged along the surface of the induction coil with one narrow edge facing outward and the flat faces of the strip facing the neighboring shunts.

The magnetic shunts 32 confine and direct the magnetic field produced by the coil winding 24. Though, as illustrated in FIG. 3, there may be small air gaps between them, the shunts 32 are magnetically coupled to each other. Provided that the magnetic field of the shunts 40 is sufficiently strong compared to that created by the induction coil 24, the induction field that would otherwise extend out from the furnace exterior does not escape the confines of the conical induction furnace. The magnetic field within the furnace also tends to be more concentrated and aligned with the conical surface of the furnace. As illustrated in FIG. 2, the induced electric current in the melt and the magnetic field from the coil interact to produce stirring currents 40, 42 in the melt 38.

Figure 4:
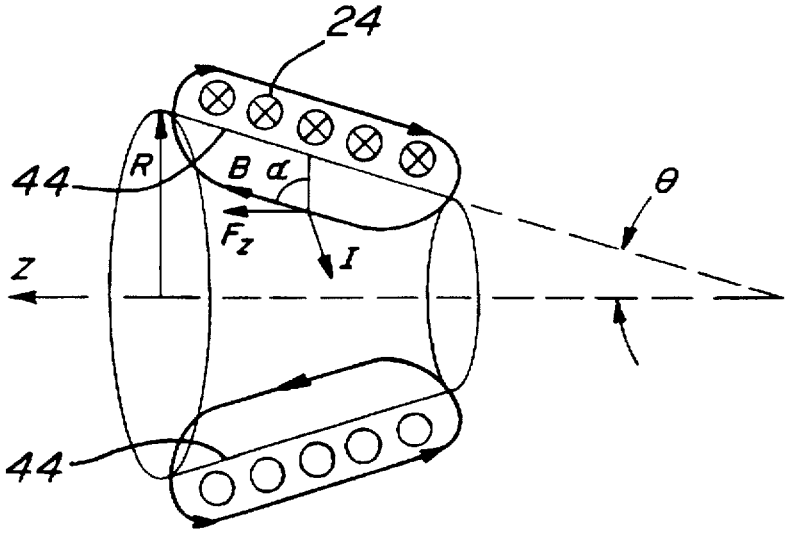
FIG. 4 is a schematic diagram of a conical furnace according to the invention.

FIG. 4 illustrates the magnetic field orientation and effect in the conical furnace of the invention. The purpose of the conically shaped induction furnace on the side of the galvanizing vessel is to generate a uniform stirring pattern of molten metal within the induction furnace and to project it into the vessel. The stirring current is the product of the Lorentz force acting on the melt.

The Lorentz force is a vector product of the tangential component electric current I in the melt and the radial component of the magnetic field B. Due to the incline θ of the induction coil 24 and furnace walls 44, the magnetic field B forms angle $\alpha=90-\theta$ with the plane of circular current induced in the melt. The interaction of the magnetic field B and current I produces axial Lorentz force $$F_z=B\times I$$

When the effect of the angle θ on the induced current is considered, the equation becomes $$|F_z|=B\cdot I\cos\theta$$

for the Lorentz force along the wall 44 of the conical furnace. This force is present in all locations of the conical metal surface and facilitates movement of the metal in one continuous loop, as shown in FIG. 2. As the above relation indicates, the magnitude of the stirring force is proportional to the cosine of the incline angle θ.

Figure 5:
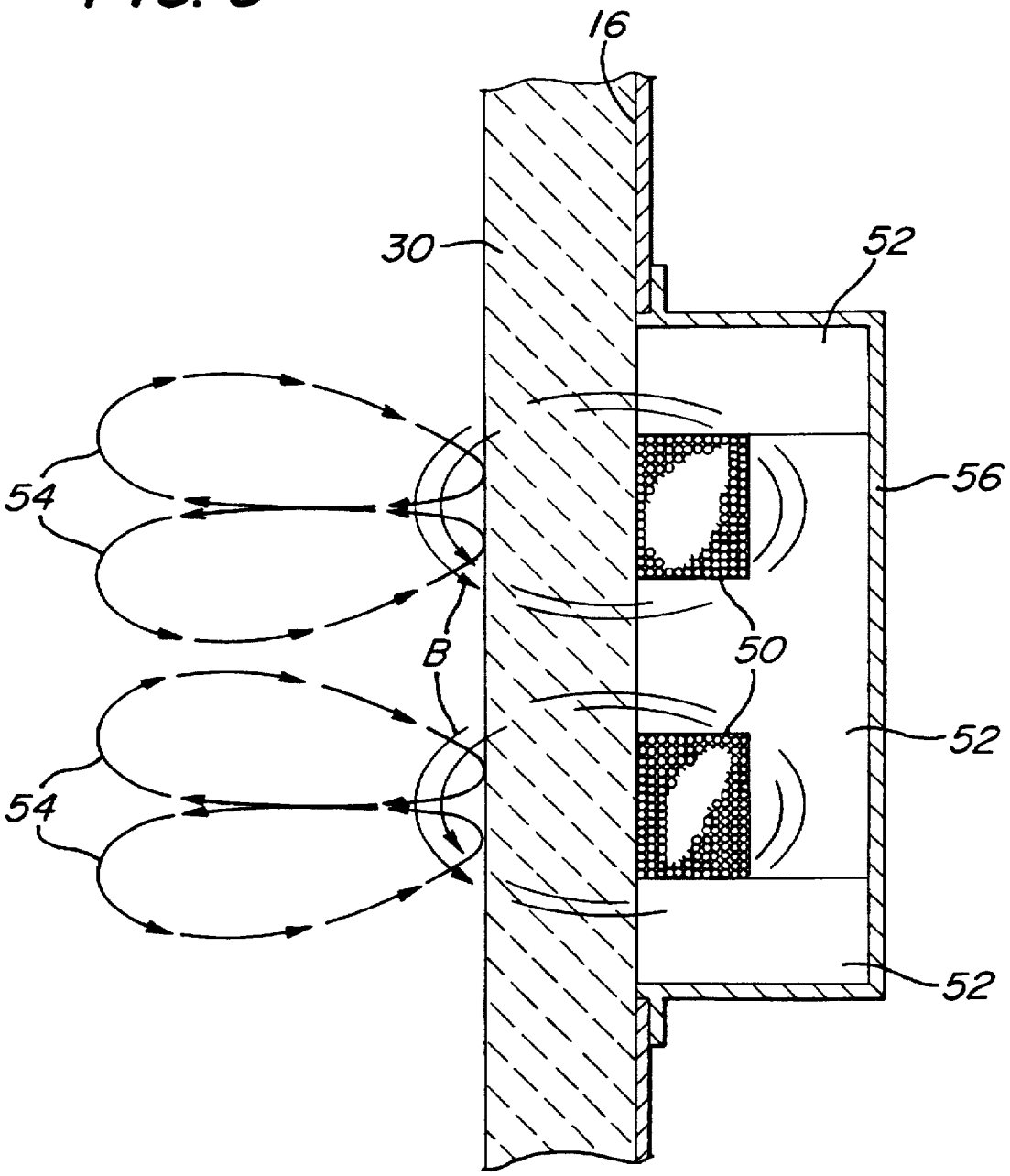
FIG. 5 is a vertical section view of a flat inductor heating element disposed on the side wall of a galvanizing pot.

A second embodiment of the present invention is shown in FIG. 5. In this embodiment, the vessel of the galvanizing apparatus has a straight interior surface 16 lined with refractory material 30. Mounted on the outside of the vessel is a flat inductor element 50. The inductor element is comprised of a many turns of electrical conductor wound in a simple shape, such as a circle or rectangle. Magnetic shunts 52 enclose the outer surface of the inductor element 50 to confine and direct the induced magnetic field B into the vessel and the melt contained within it.

The Lorentz forces associated with the induced magnetic field and electric current in the melt produce stirring currents 54 in the melt. The stirring currents 54 flow away from the center of the windings of the inductor element 50, causing part of the melt to flow toward the inductor element to replace the metal flowing away from it.

The combination of inductor element 50 and associated magnetic shunts 52 are enclosed within a shell 56 of suitable material.

Figure 6:
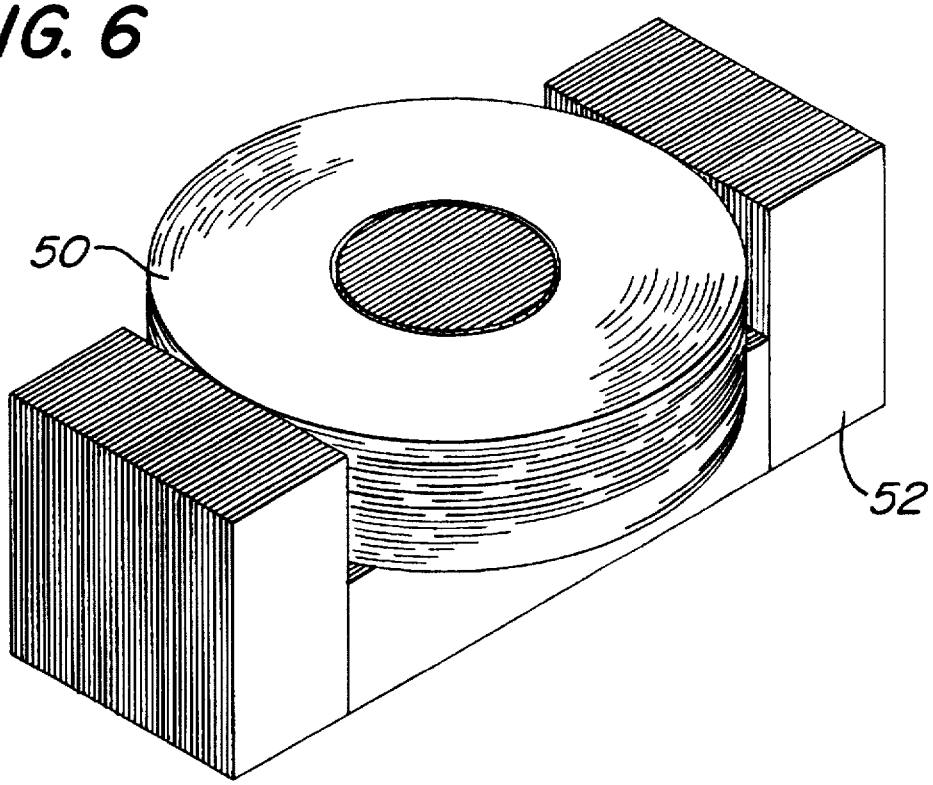
FIG. 6 is a perspective view of a flat round induction heating coil.
Figure 7:
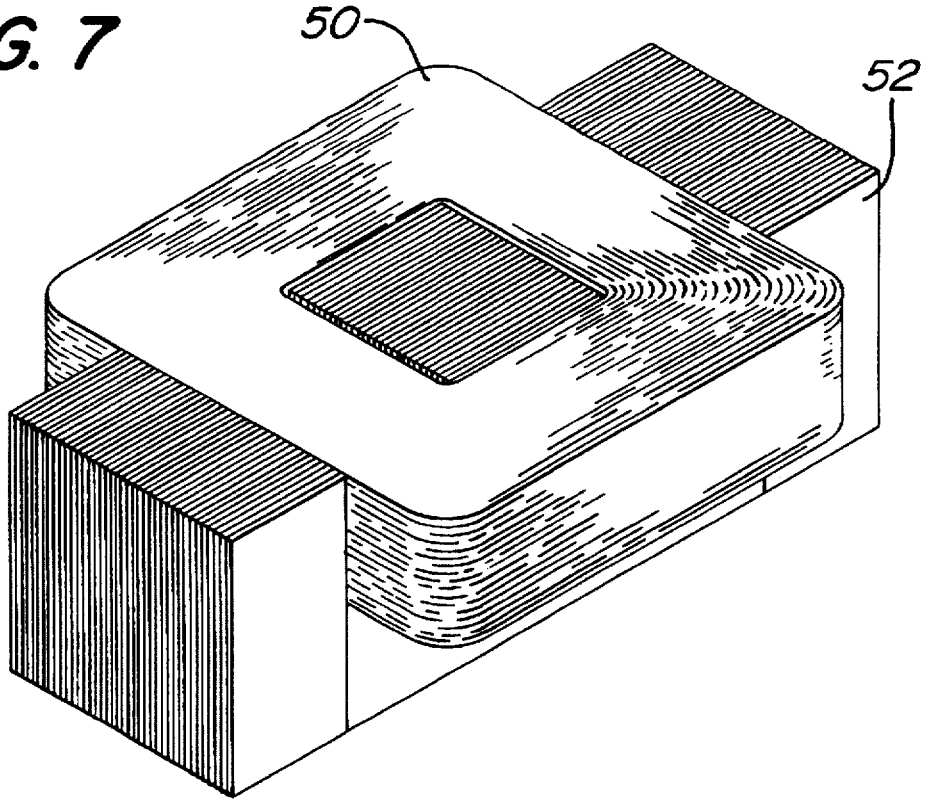
FIG. 7 is a perspective view of a flat rectangular induction heating coil.

FIGS. 6 and 7 illustrate two forms that the wound flat inductor 50 can take, though there may be several equally useful forms. FIG. 6 shows a circular wound inductor 50 comprised of many turns of electrical conductor. FIG. 7 shows a rectangular inductor 50. Both of these inductors are enclosed on one side by magnetic shunts 52. The shunts 52 also occupy the void at the center of the windings of each inductor. Thus, where the magnetic field would otherwise diffuse into a less focused shape toward the center of the inductor, the shunt material in the center forces the field outward toward the melt when the inductor 50 is mounted on the wall of the galvanizing vessel.

The present invention may be embodied in other specific forms without departing from the spirit or essential attributes thereof and, accordingly, reference should be made to the appended claims, rather than to the foregoing specification, as indicating the scope of the invention.

What is claimed is:

1. A galvanizing apparatus for heating liquid metal coatings comprising:

a vessel for holding molten metal, said vessel having a bottom and vertical side walls, said side walls having interior and exterior surfaces and at least one coreless induction furnace;

said coreless induction furnace comprising a conical projection outward from said vessel side walls, said projection being formed in both the interior and exterior surfaces of the side walls such that both the interior and exterior surfaces of the side walls form an outward projection having a conical shape, said at least one conical projection having a widest radius adjacent to the side walls, said radius decreasing along the outward projection from the side walls, and at least one induction heating coil for heating and stirring the molten metal helically wound on said conical projection on the vessel exterior such that the induction heating coil takes the shape of the conical projection.

2. The galvanizing apparatus of claim 1, wherein the vessel interior surface is lined with refractory material, said refractory material conforming to the said at least one outward conical projection from the side walls.

3. The galvanizing apparatus of claim 1, wherein a plurality of magnetic shunts are disposed around the induction heating coil.

4. The galvanizing apparatus of claim 3, wherein each of said plurality of magnetic shunts is arranged axially over the coil from the widest radius of the conical projection to the narrow radius.

5. The galvanizing apparatus of claim 4, wherein said plurality of magnetic shunts are arranged in substantially circular configuration, said magnetic shunts forming a collective conical magnetic shunt over the induction coil.

6. The galvanizing apparatus of claim 5, wherein a protective shell shields the coil and magnetic shunts on the exterior of said conical projection.

7. A galvanizing apparatus for heating liquid metal coatings comprising a circular vessel for holding molten metal, said vessel having a bottom and a round vertical side wall, said side wall having interior and exterior surfaces, and at least one coreless induction furnace;

said coreless induction furnace having a conical projection outward from said side wall, said projection being formed in both the interior and exterior surfaces of the side wall such that both the interior and exterior surfaces of the side wall form an outward projection having a conical shape, said conical projection having a widest radius adjacent to the side wall, said radius decreasing along the outward projection from the side wall, and at least one induction heating coil for heating and stirring the molten metal helically wound on said conical projection on the vessel exterior such that said coil takes the shape of the conical projection.

8. A galvanizing apparatus for heating liquid metal coatings comprising a vessel for holding molten metal, said vessel having a bottom and vertical side walls, said side walls having interior and exterior surfaces; and, at least one flat induction coil for inducing a magnetic field in said vessel, said flat inductor being disposed against the exterior surface of a side wall.

9. The galvanizing apparatus of claim 8, wherein said flat induction coil is encompassed by a magnetic shunt for confining the magnetic field of the induction coil.

10. The galvanizing apparatus of claim 8, said flat induction coil comprising multiple conductor turns formed in a circular shape around a central opening.

11. The galvanizing apparatus of claim 8, said flat induction coil comprising multiple coil turns formed in a rectangular shape around a central opening.

* * * * *